United States Patent [19]

Weiss

[11] 4,401,919

[45] Aug. 30, 1983

[54] INDIRECTLY HEATED WEHNELT CATHODE

[75] Inventor: Eberhard Weiss, Stuttgart, Fed. Rep. of Germany

[73] Assignee: ITT Industries, Inc., New York, N.Y.

[21] Appl. No.: 283,328

[22] Filed: Jul. 15, 1981

[30] Foreign Application Priority Data

Aug. 7, 1980 [DE] Fed. Rep. of Germany ..... 3029853

[51] Int. Cl.[3] ..... H05B 39/04; H05B 41/36; H01J 1/20

[52] U.S. Cl. ..... 315/107; 315/94; 313/337; 313/5

[58] Field of Search ..... 315/94, 102, 107; 313/5, 337, 339, 356

[56] References Cited

U.S. PATENT DOCUMENTS

| | | | |
|---|---|---|---|
| 2,291,864 | 8/1942 | Bennett | 313/5 X |
| 3,553,521 | 1/1971 | Bakker et al. | 313/356 X |
| 3,569,768 | 3/1971 | Benda | 313/337 X |
| 3,914,638 | 10/1975 | Collins et al. | 313/337 X |

*Primary Examiner*—Eugene La Roche
*Assistant Examiner*—Vincent DeLuca
*Attorney, Agent, or Firm*—John T. O'Halloran

[57] ABSTRACT

To achieve an optimum reduction of the warmup time of a Wehnelt cathode, by maintaining a good efficiency, it is proposed to use as a cathode a triode system arranged within the usual cathode sleeve, with the inside of the base plate, on the outside of which the electron-emitting layer is deposited, serving as the anode, so that the electron-emitting layer is heated by the anode dissipation of the triode system.

4 Claims, 1 Drawing Figure

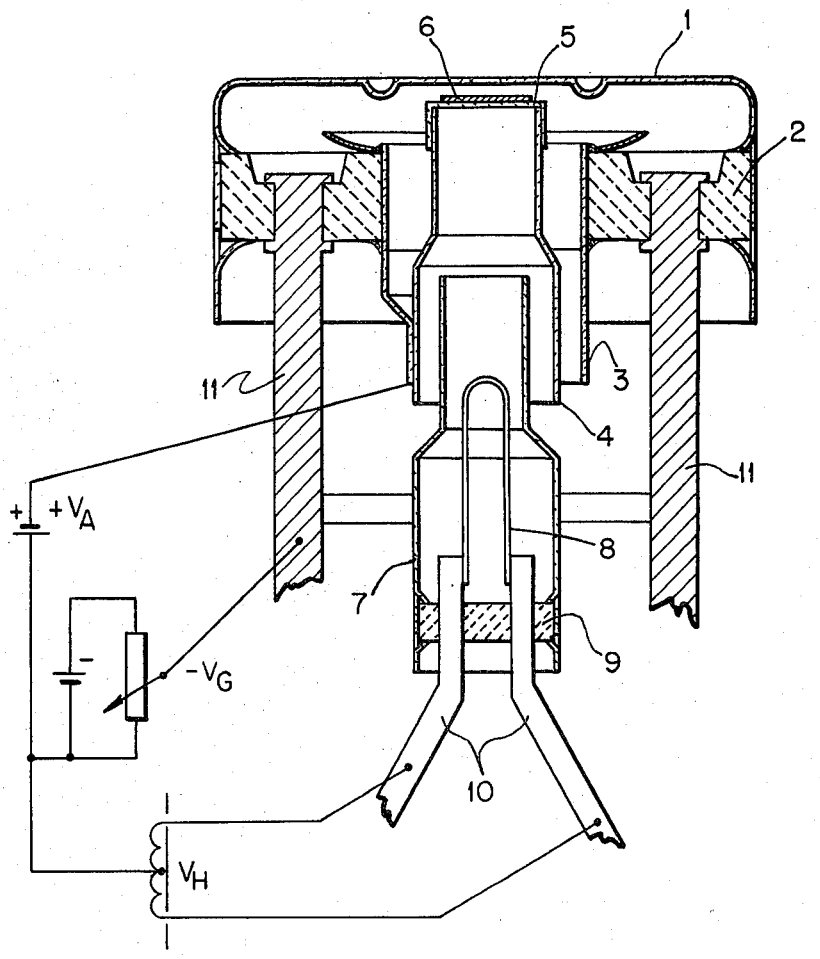
6
5
1
2
11
3
4
11
+
+V_A
8
7
9
-
-V_G
10
V_H

INDIRECTLY HEATED WEHNELT CATHODE

The invention relates to an indirectly heated Wehnelt cathode, especially for the use with cathode-ray tubes such as oscillograph, television and color television picture tubes in which, on the outside of the base plate of a cathode sleeve, there is arranged an electron-emitting layer which is excited to emit electrons by a source of heat arranged within the cathode sleeve.

Usually, this heat source consists of a coiled heating wire designed as a coiled coil or folded to the shape of a hairpin and coated with a layer of insulating material substantially consisting of aluminum oxide, which is then inserted into the cathode sleeve. For such heaters to be almost provided with the properties of a black-body emitter, heavy-metal particles are embedded into the insulating aluminum oxide, providing the insulating compound of the coating with the desired emitting properties as well as with a dark color. Corresponding examples are given in DE-AS Nos. 23 17 445; 23 17 446 and 23 64 403. With these types of heaters the warmup time of cathode-ray tubes provided therewith, was able to be reduced substantially. In order to achieve a further reduction of the warmup time, it has been proposed by DE-OS No. 26 54 553 to arrange heat-conducting metal members inside the cathode sleeve. The German Patent Application No. P 29 38 248 proposes to distribute the heater windings and/or the insulating compound inside the cathode sleeve so irregularly that the heat is concentrated in the close proximity of the base plate of the cathode sleeve, thus resulting in a quicker heating of the emitting layer.

According to another type of heat source, a heat radiation is produced by a bare heating wire, which is directed to a small plate carrying the emitting layer, thus causing the emitting layer to emit electrons. Corresponding examples are disclosed in DE-OS Nos. 26 14 270 and 28 35 489.

Both of the conventional types of heat sources either only permit a restricted reduction of the warmup time or show to have an unsatisfactory efficiency. It is the object of the present invention therefore, by maintaining the hitherto conventional constructional design of the cathode and, consequently, also the well-proven structure of the electrode system of an electron gun to provide a solution for the heat source to be arranged inside the cathode sleeve, which permits a reduction of the warmup time, as well as an improvement of the efficiency. According to the invention, this object is achieved by the features set forth in claims 1 and 2.

The invention will now be described in greater detail with reference to an example shown in the accompanying drawing, with this drawing showing a section taken through a Wehnelt cathode with a cathode sleeve and with an emitting layer deposited on the base plate thereof, enclosed by a Wehnelt cylinder.

In referring to the drawing, the reference numeral 1 indicates a Wehnelt cylinder which, via not shown supporting webs sealed into glass-ceramic rods supporting the entire system structure, is fixed in its position. Inside the Wehnelt cylinder 1, and with the aid of an insulating ring 2 of glass, glass-ceramics or ceramics, there is secured the one end of a supporting sleeve 3, to the other free end of which the cathode sleeve 4 is connected spotwisely, with the end thereof facing the bottom of the Wehnelt cylinder, being closed by a cathode cap 5 of cathode nickel, which then carries the electron-emitting layer 6.

Up to now, the heater coated with a layer of insulating material was slipped into the cathode sleeve 4, and its terminals were connected to supporting pins 11 secured in the insulating ring 2. According to the present invention, coaxially in relation to the cathode sleeve 4, there is inserted a control cylinder 7 in the inside of which, on terminals (10) arranged on an insulating disk 9, there is arranged a heater 8. The heater 8, the control cylinder 7 and the inside of the cathode cap 5 now form the directly heated triode system in which the control cylinder 7 by serving as the control electrode, receives a bias which is negative with respect to the heater 8, and in which the cathode cap 5 as the anode receives an anode voltage which is positive with respect to the heater 8. As in the case of conventional electron tubes, the electron stream as emitting from the heater in dependence upon the magnitude of the negative control electrode voltage, is accelerated towards the anode, impinges upon the latter and, as an anode dissipation, is fully converted into heat, because no useful power is taken off the system.

Although the mode of operation of electron tubes may be assumed to be generally known, reference is made, amongst others, to the book by L. Ratheiser: "Rundfunkröhren", Berlin, 1949. Compared with a conventional triode system, the triode structure according to the invention shows to have the following special feature: The control electrode of this triode system, unlike the conventional amplifier tube triode systems, does not consist of a wire spiral connected by wire webs, but of a control cylinder 7 extending coaxially in relation to the cathode sleeve. Owing to the field distribution appearing at the output of this control cylinder, there is formed an accelerating electron lense converging the electrons into a narrow beam, and directing them to the base plate of the cathode sleeve 4 formed by the cathode cap 5, hence to a point lying exactly opposite the opening in the Wehnelt cylinder 1. Accordingly, in a Wehnelt cathode according to the invention the surface to which heat is applied for the emitting purpose, can be kept considerably smaller than in the case of the conventional types of indirectly heated cathodes. If, as already customary hitherto, for the cathode sleeve 4 there is taken a material having as poor as possible conducting properties, and by which the heat dissipation via the cathode sleeve 4 can be kept at a low level, it is possible for the structure according to the invention to be realized in an almost ideal manner in that only the surface which is absolutely required for operating a cathode-ray tube, is the hottest point of the entire cathode structure. In this way it is possible to achieve small heat losses and, consequently, a good efficiency.

As the heater 8 it is possible to use all types of heaters (filaments) known from the fields of amplifier tube engineering. As examples there are only mentioned:

1. The barium-vapor filament, where a layer of barium having an excellent emitting power, is evaporated in vacuum onto a filament of tungsten oxide, has a useful emission of about 70 mA/W at a working temperature of approximately 750° C.

2. The barium-paste filament, where a barium paste is deposited on a filament consisting of tungsten—or nickel—or of a nickel alloy, and activated in vacuum, has a useful emission of about 50 mA/W at a working temperature of approximately 800° C.

3. The thoriated (tungsten) filament, where 1–2% of thorium oxide is added to the tungsten, from which, in vacuum, there is formed a molecularly strong, well-emissive film of thorium, has a useful emission of about 25 mA/W at a working temperature of approximately 1500° C.

Further materials for and activating agents to be added to such filaments can be found in the relevant literature, such as W. Espe: "Werkstoffkunde der Hochvakuumtechnik", Berlin, 1959, and in other literature published by tube manufacturers.

It is unimportant with respect to the design of the cathode sleeve 4 whether the end facing the Wehnelt cylinder 1 is closed by a cathode cap 5 of cathode nickel as is shown in the drawing, or whether a base plate of cathode nickel is inserted at this point, as is shown in the drawing of DE-AS No. 28 13 504, or whether in accordance with DE-OS No. 26 54 554, both the cathode sleeve and the cathode cap 5 are made in one piece from an alloy which, on one hand, has no unfavorable influence upon the material of the emitting compound but, on the other hand, also has the desired poor heat conductivity in order to keep the heat losses at a low level.

In specimen color picture tubes manufactured for experimental and testing purposes the heater voltage $V_H$ of each system amounted to approximately 2 volts and the heater current on the average amounted to 100 mA. The anode voltage $V_A$ amounted to about 800 V and the average anode current amounted to 0.75 mA. The control cylinder bias $-V_G$ was able to be adjusted between 0 and $-100$ V with respect to the center of the heater. Accordingly, heating of the Wehnelt cathode involved an anode dissipation of 800 $V \times 0.75.10^{-3}A = 0.6$ W plus a power supply for the heater 8 of 2 $V \times 0.1 \cdot A = 0.2$ W, hence altogether approximately 0.8 W per system. Conventional color picture tubes, at a heater voltage of 6.3 V, require a heater current of approximately 250 mA, hence altogether almost a filament power of 1.6 W per system, which is double the amount. When assuming that power is supplied via the line transformer as is customary with television receivers, and that an oscillating build-up delay etc. is caused thereby, a picture tube employing the Wehnelt cathode according to the invention shows to have warmup times ranging between 1.5 and 2.5 sec. from turning on the receiver. This time can be reduced when the supply of the control cylinder 7 is made in such a way that, upon turning on the receiver, the negative bias runs up from the value 0 to the required negative ultimate value e.g. in approximately 1 sec. This may be effected with the aid of a capacitor connected in parallel with the control cylinder's source of bias and which, owing to the relatively high source impedance, is only charged slowly, so that accordingly the beam current of the triode system is adjusted correspondingly slow from higher values to the operating value. By suitably selecting the time constant it can be achieved that, upon turning on, the temperature of the emitting surface, without any overshoot, reaches its desired value in a quicker way. Accordingly, the warmup time can be further reduced to about 1 sec.

To sum up it can be said that with the aid of the Wehnelt cathode according to the invention, the warmup time can be reduced to about one half or one fifth of the time customary hitherto, by simultaneously reducing the filament power to approximately one half. Since, owing to the reduced filament power, also the heat load of the system is reduced substantially, the convergence problems arising from the influence of heat are reduced considerably.

I claim:

1. An indirectly heated Wehnelt cathode, especially for the use with cathode-ray tubes such as oscillograph, television and color television picture tubes in which, on the outside of the base plate of a cathode sleeve, there is arranged an electron-emitting layer which, by a source of heat arranged within the cathode sleeve, is excited to emit electrons, wherein the improvement comprises:

said source of heat being a directly heated triode system having a cathode, a control electrode and an anode, the inside of said base plate of said cathode sleeve serving as the anode.

2. An indirectly heated Wehnelt cathode as claimed in claim 1, wherein the control electrode of said triode system is designed as a control cylinder extending coaxially in relation to said cathode sleeve.

3. An indirectly heated Wehnelt cathode as claimed in claim 2, wherein the cathode of said triode system comprises a heater filament having terminals which are electrically insulatedly inserted into the end of said control cylinder which is distant from said base plate of said cathode sleeve.

4. A method of reducing the warmup time of cathode ray tubes employing indirectly heated Wehnelt cathodes as claimed in any one of claims 1 to 3, wherein upon turning on the system a negative bias is applied to said control electrode, by starting from 0 value or any given low value and is increased in such a way, by simultaneously reducing the beam current of said triode system that the electron-emitting layer on the outside of said base plate of said cathode sleeve, is provided with the desired operating temperature value without causing any overshoot.

* * * * *